US006367301B1

(12) United States Patent
Bassani

(10) Patent No.: US 6,367,301 B1
(45) Date of Patent: Apr. 9, 2002

(54) HIGH SPEED CRIMPING APPARATUS

(75) Inventor: Lavinio Bassani, Montréal-Rivière des Prairies (CA)

(73) Assignee: Capmatic Ltd., Montreal-Nord (CA)

( * ) Notice: Subject to any disclaimer, the term of this patent is extended or adjusted under 35 U.S.C. 154(b) by 0 days.

(21) Appl. No.: 09/663,191

(22) Filed: Sep. 15, 2000

(51) Int. Cl.[7] ..... B21B 19/00

(52) U.S. Cl. ..... 72/94; 53/331; 53/334; 413/31

(58) Field of Search ..... 413/2, 6, 10, 12, 413/31; 53/331, 334, 488; 72/94, 102, 111, 452.4, 452.5, 452.6, 452.7; 74/568 R

(56) References Cited

U.S. PATENT DOCUMENTS 4,087,952 A * 5/1978 Spies ..... 53/334
4,099,361 A * 7/1978 Dix et al. ..... 53/331
4,219,986 A * 9/1980 Osterhaus ..... 53/334
4,662,153 A * 5/1987 Wozniak ..... 53/334
5,522,200 A * 6/1996 Foldesi et al. ..... 53/75
5,911,552 A * 6/1999 Shimizu et al. ..... 53/334

* cited by examiner

*Primary Examiner*—Ed Tolan
(74) *Attorney, Agent, or Firm*—Ratner & Prestia

(57) ABSTRACT

A crimping apparatus, comprising a revolving turret supporting a plurality of crimping heads, each crimping head operative to engage a closure on a container to create a crimp in the closure. The crimping head includes a cam follower riding on a stationary cam. The movement imparted by the cam profile to the cam follower is communicated to a crimping tool that engages the closure. The cam defines a plurality of cam follower receiving positions, each position establishing a different profile. The cam can be selectively displaced relative to the revolving turret to alter the position at which the cam follower engages the cam and thus the profile followed by the cam follower.

17 Claims, 4 Drawing Sheets

HIGH SPEED CRIMPING APPARATUS

FIELD OF THE INVENTION

The invention relates to an apparatus for crimping closures applied on containers. The apparatus is characterized by a mechanism that allows the automatic adjustment of the position of the crimping heads of the apparatus.

BACKGROUND OF THE INVENTION

It is common practice to commercialize or distribute for use liquid pharmaceutical compositions in vials that are sealed with crimp-type closures. Typically, a crimp-type closure includes a resilient plug member that is surrounded by a metallic sleeve. When the closure is applied on the container, the resilient plug member is inserted in the mouth of the container to create a fluid-tight seal. The metallic sleeve fits outside the mouth of the container and has a length sufficient such as to extend below a radial projection formed on the container and located adjacent to its mouth. The purpose of the sleeve is to lock the closure on the container mouth and prevent the closure from being removed unless the sleeve is torn of otherwise pulled off the container. To lock the sleeve, the container is subjected to a crimping operation. During that crimping operation, the lower extremity of the sleeve is bent radially inwardly such as to interfere with the radial projection on the container neck if an attempt is made to pull the closure off.

Crimp-type closures are usually applied on the containers filled with the medicinal preparation by automatic capping machines. During the capping operation, filled containers are transported to a first processing station where crimp-type closures are dropped onto them. If necessary, a pressure is applied such as to forcibly insert the resilient plug member of the crimp-type closure in the mouth of each container. The last step of the capping operation is to crimp the closures. This is done by a crimping machine that has a revolving turret carrying a plurality of crimping heads, each crimping head being associated with a container to be crimped.

The crimping head comprises a crimping tool that is in the form of a circular blade. The circular blade registers with the closure at the location where the crimp is to be made. The crimping blade is then advanced against the container to initiate the crimping operation. At the same time, the container is rotated about its vertical axis to effect a complete revolution that will complete the crimp. The crimping head is then retracted and the container allowed to proceed toward the next processing station whereupon a further operation is performed such as the application of the label, etc.

A problem associated with existing crimping machines is the necessity to manually adjust the position of each crimping head on the revolving turret when the machine is being set up for a new production run. Since different size containers require a different geometrical relationship between the crimping tool and the neck of the container, the position of each crimping head on the revolving turret must be adjusted manually. This operation is time consuming. In addition, the operation must be performed by experienced personnel to avoid situations where one or more of the crimping heads are improperly positioned thereby resulting in improper crimping when the machine is run.

Against this background, it clearly appears that there is a need in the industry to provide an automatic crimping machine on which the crimping heads can be automatically adjusted.

SUMMARY OF THE INVENTION

In a broad aspect, the invention provides a crimping apparatus comprising a revolving turret, a cam, and a plurality of crimping heads supported by the revolving turret. Each crimping head includes a cam follower for engaging one of a plurality of possible cam follower receiving positions defined by the cam. When the revolving turret is in motion, the cam follower tracks the selected cam follower receiving position that is characterized by a certain profile. The profile determines the movement imparted to the crimping head by the cam follower. The cam follower can be located at a different cam receiving position on the cam by displacing the cam and the revolving turret one relative to the other.

The ability to set the cam follower at different cam follower receiving positions allows to quickly perform the necessary changes to the apparatus so as to set it for a production run. For instance, each cam follower receiving position can have a unique profile that makes it suitable for use with a particular container size or type. Thus, by selecting the proper cam follower receiving position the adjustment of the machine is quickly effected.

In a specific non-limiting example of implementation, the revolving turret and the cam are selectively displaceable one relative to the other along the axis of revolution of the revolving turret. More specifically, the axis of revolution is generally vertical. The cam is tapered and defines a plurality of cam follower receiving positions arranged along the direction of taper. A cam follower receiving position is the portion of the cam surface that the cam follower tracks during the revolution of the revolving turret. This portion of the cam surface is characterized by a certain profile. By displacing the revolving turret with relative to the cam, the cam follower engages a different portion of the cam, hence it tracks a different cam follower engaging position.

Under this specific and non-limiting example of implementation, the crimping apparatus comprises a second revolving turret which underlies the first revolving turret and which is associated with the first revolving turret. The second revolving turret, which rotates at the same speed as the first revolving turret, comprises a plurality of container seats which are associated with respective crimping heads. In operation, each container seat supports a container while its associated crimping head crimps the closure of the container.

The crimping heads, which are mounted to the first revolving turret at constant angular intervals, each include a substantially vertically extending body. Each crimping head's respective cam follower is mounted to an upper end of the body while the lower end of that same body includes an arm supporting a crimping too; the latter being typically in the form of a disk.

BRIEF DESCRIPTION OF THE DRAWINGS

A detailed description of examples of implementation of the present invention is provided hereinbelow with reference to the following drawings, in which.

Figure 1:
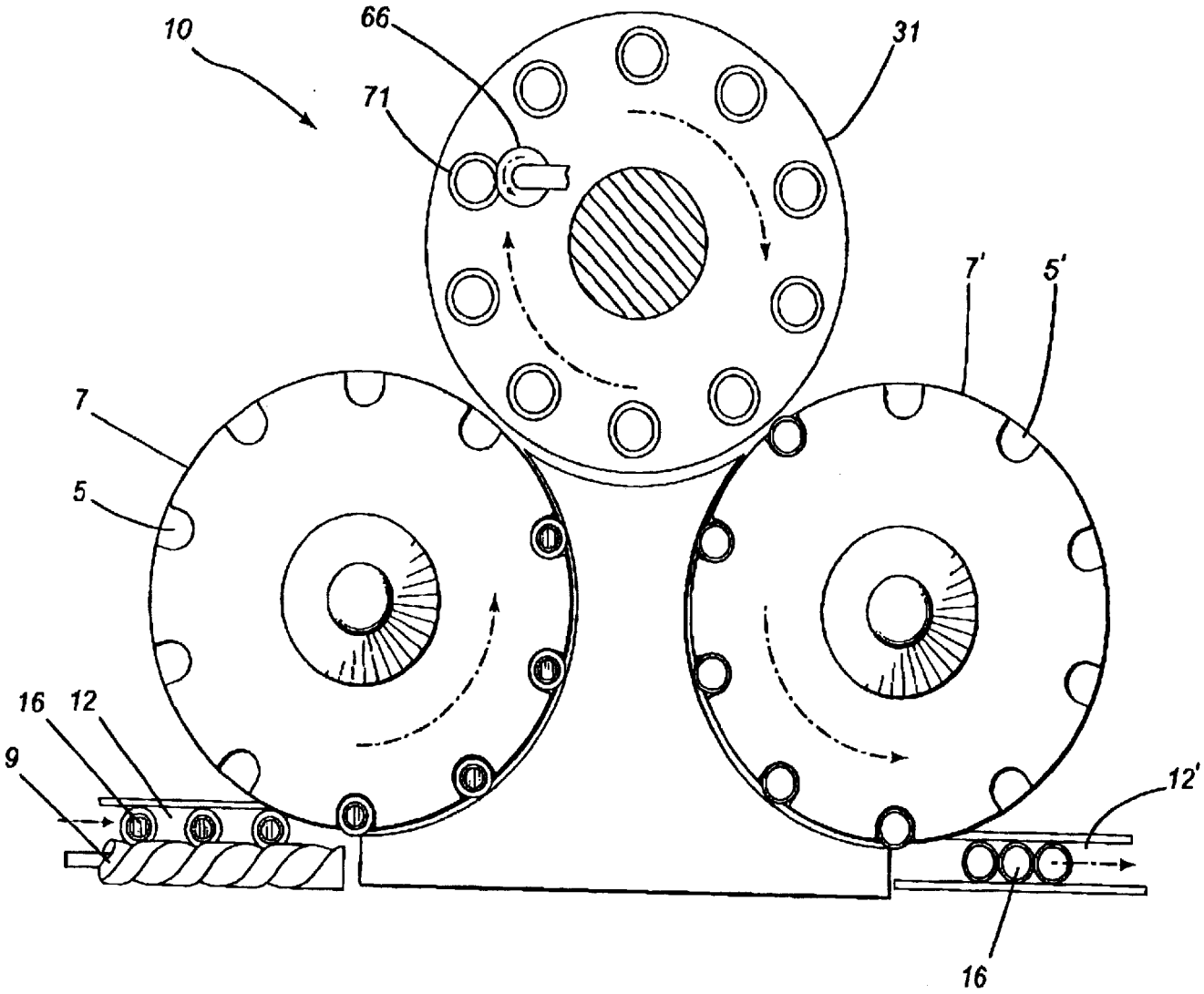
FIG. 1 is an illustration of a crimping apparatus constructed in accordance with the present invention.

In the drawings, embodiments of the invention are illustrated by way of examples. It is to be expressly understood that the description and drawings are only for purposes of illustration and as an aid to understanding, and are not intended to be a definition of the limits.

DETAILED DESCRIPTION OF THE DRAWINGS

Figure 2:
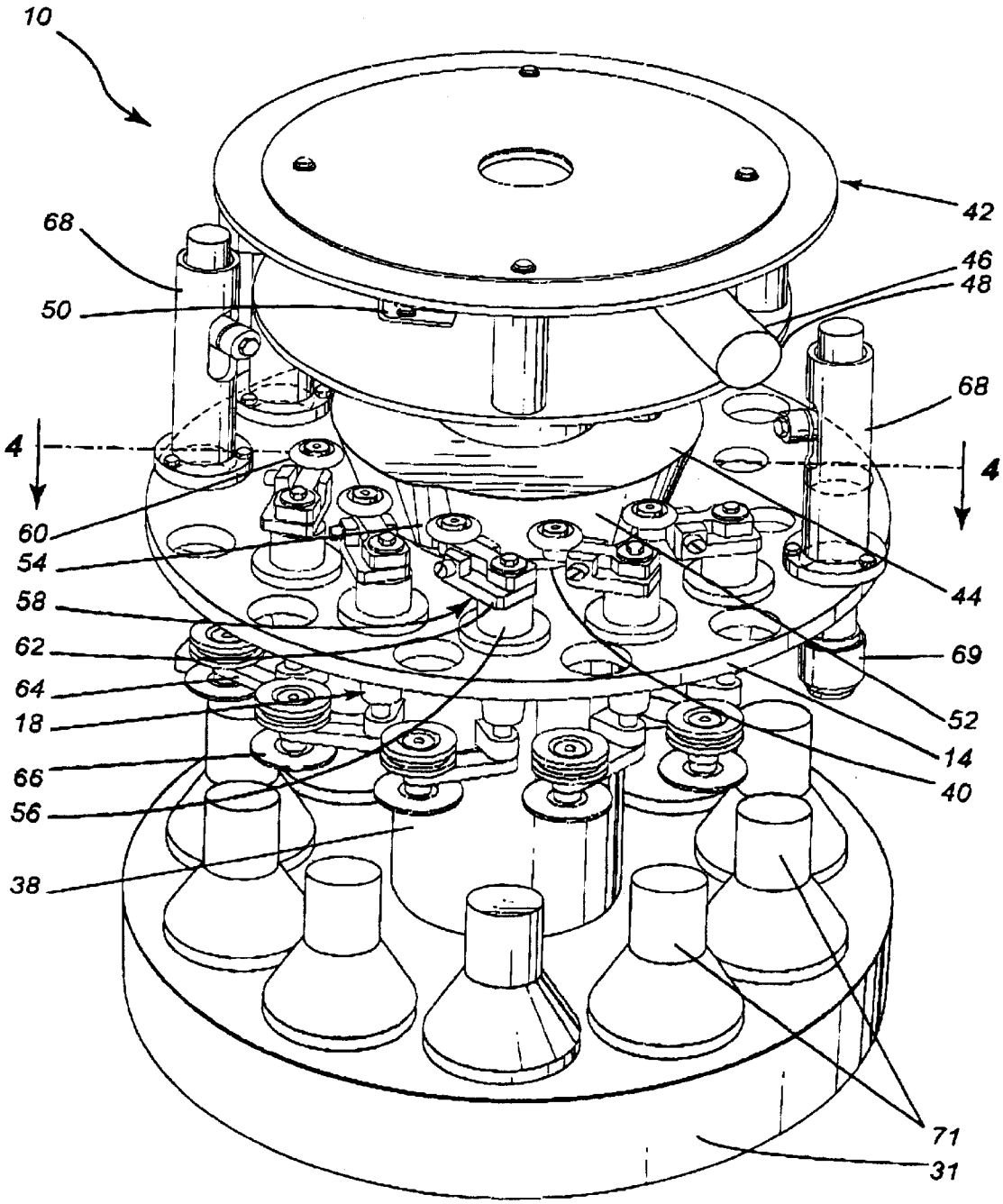
FIG. 2 is a detailed perspective view of a revolving turret of the crimping apparatus shown in FIG. 1.

FIG. 1 illustrates a crimping apparatus 10 constructed in accordance with the principles of the present invention. The crimping apparatus 10 includes an inlet conveyor 12, a feed screw 9, an infeed star wheel 7, an upper revolving turret 14 (not shown for the sake of clarity), an outfeed star wheel 7', and an outlet conveyor 12'. The inlet conveyor 12 is designed to transport a plurality of containers 16 in random sequence. Upon reaching a feed screw 9, each container 16 individually engages a recess created by the threads of feed screw 9 as the latter rotates about a horizontal axis. Thus, feed screw 9 positions the containers in a single file, and transports them in equi-distant fashion toward an infeed star wheel 7. Infeed star wheel 7, which features a plurality of slots 5 along its outer periphery, rotates about a horizontal plane. The containers 16 are received within the slots 5 of infeed star wheel 7 and are thereby transported toward an upper revolving turret 14, as shown in FIG. 2, which comprises a plurality of crimping heads 18 mounted along its periphery. More specifically, the containers 16 are transported toward a lower revolving turret 31, which underlies the upper revolving turret 14, and which includes a plurality of container seats 71 disposed about its periphery. The containers 16, once deposited on respective container seats 71, can then interact with the crimping heads 18 which crimp closures placed on their respective mouths. The containers 16 are shown in greater detail at FIG. 3.

Figure 3:
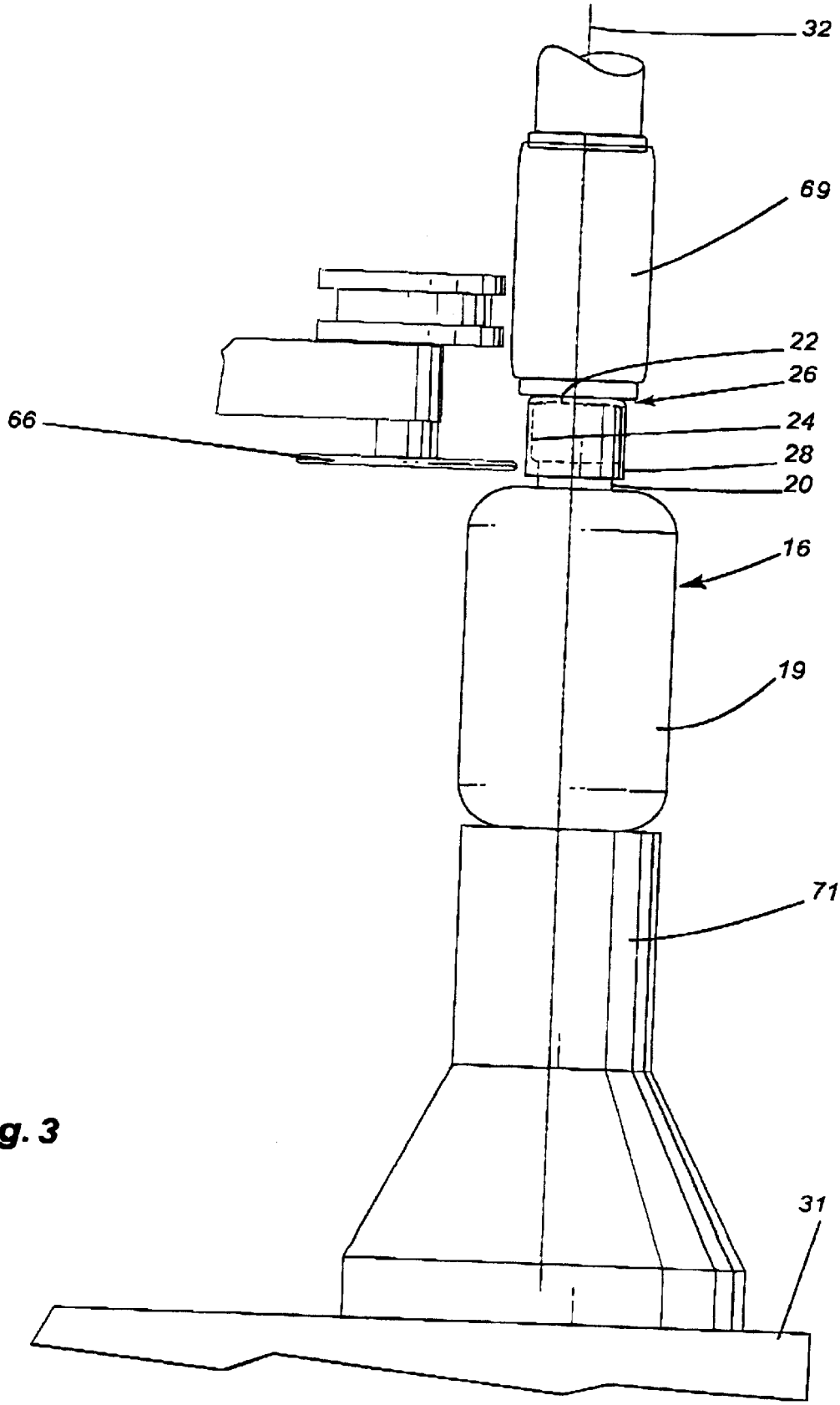
FIG. 3 is a fragmentary elevational view of a container on which has been applied a closure that has not yet been crimped. This figure also shows the crimping tool of the crimping apparatus on the point of engaging the closure to perform the crimping operation.

The container 16 includes a body 19. In a specific example of implementation, the containers shown at FIG. 3 are vials suitable for holding medicinal substances such as injectable liquids. Such vials are typically made of glass material. The container 16 has an upwardly projecting neck 20 that terminates at its upper end by an open mouth portion 22. Immediately below the mouth portion 22, the neck is provided with a radial projection 24 on which the closure used to seal the container 16 is affixed. The container 16 is designed to receive a crimp-type closure 26. The crimp-type closure 26 has two principal elements, namely a central resilient plug (not shown in the drawings) that is inserted in the mouth 22 of the container in order to create a fluid-tight seal. The second principal element of the closure 26 is an outer metallic sleeve 28 that is placed outside the neck 20 of the container 16. The sleeve 28 has a height sufficient such as to extend below the radial projection 24. When the closure 26 is crimped, the portion of the sleeve 28 that extends below the radial projection 24 is bent inwardly along the entire circumference of the neck 20 to create a stop or abutment. This stop or abutment interferes with the radial projection 24 if one attempts to remove the closure 26. Evidently, the closure 26 can be removed by tearing away the sleeve 28. In certain kinds of crimp-type closures, the sleeve 28 from the container 16 so as to allow the user to remove the plug.

During the crimping operation of the closure 26, the containers 16 are supported by container seats 71. In addition to the function of supporting the container 16, the container seats 71 also serve the purpose of accurately maintaining the registration of the individual container 16 with its corresponding crimping head 18, as seen in FIG. 2. At this end, the container seats 71 are mounted to lower revolving turret 31 which is adapted to rotate in a horizontal plane. Each container seat 71 is designed to impart a rotary movement to the container 16 about the vertical axis 32 shown in FIG. 3. The various drive elements that cause the container seats 71 to rotate about their respective vertical axes have not been shown for the purposes of clarity, it being understood that such drive elements are well known to those skilled in the art and they are not critical to the success of the invention.

Although FIG. 3 shows the container seats 71 as being adapted to the specific shape and size of the containers 16, it should be expressly understood that the container seats 71 are capable of readily being changed in order to conform to containers of differing cross-sectional areas and shapes.

Both the lower and upper revolving turrets 31, 14 are mounted to a drive system that enables them to rotate about a vertical axis. In one example of implementation, the drive system is an electric motor. Many other possibilities exist without departing from the spirit of the invention.

FIG. 2 shows that upper revolving turret 14, which is in the form of a ring, carries a plurality of crimping heads 18. The crimping heads 18 are disposed near the outer periphery of upper revolving turret 14 and they are equi-spaced. Upper revolving turret 14 also includes an inner circular aperture 40 through which a drive shaft 38 is mounted. Both the upper and lower revolving turrets 14, 31 are mounted to the drive shaft 38 which functions to impart a rotary motion to both turrets. In this fashion, the speed of rotation of the upper revolving turret 14 is identical to the speed of rotation of the lower revolving turret 31 which thereby implies that a crimping head 18 will travel with a container 16 at the same speed and will remain physically associated therewith such as to perform the crimping operation.

Figure 4:
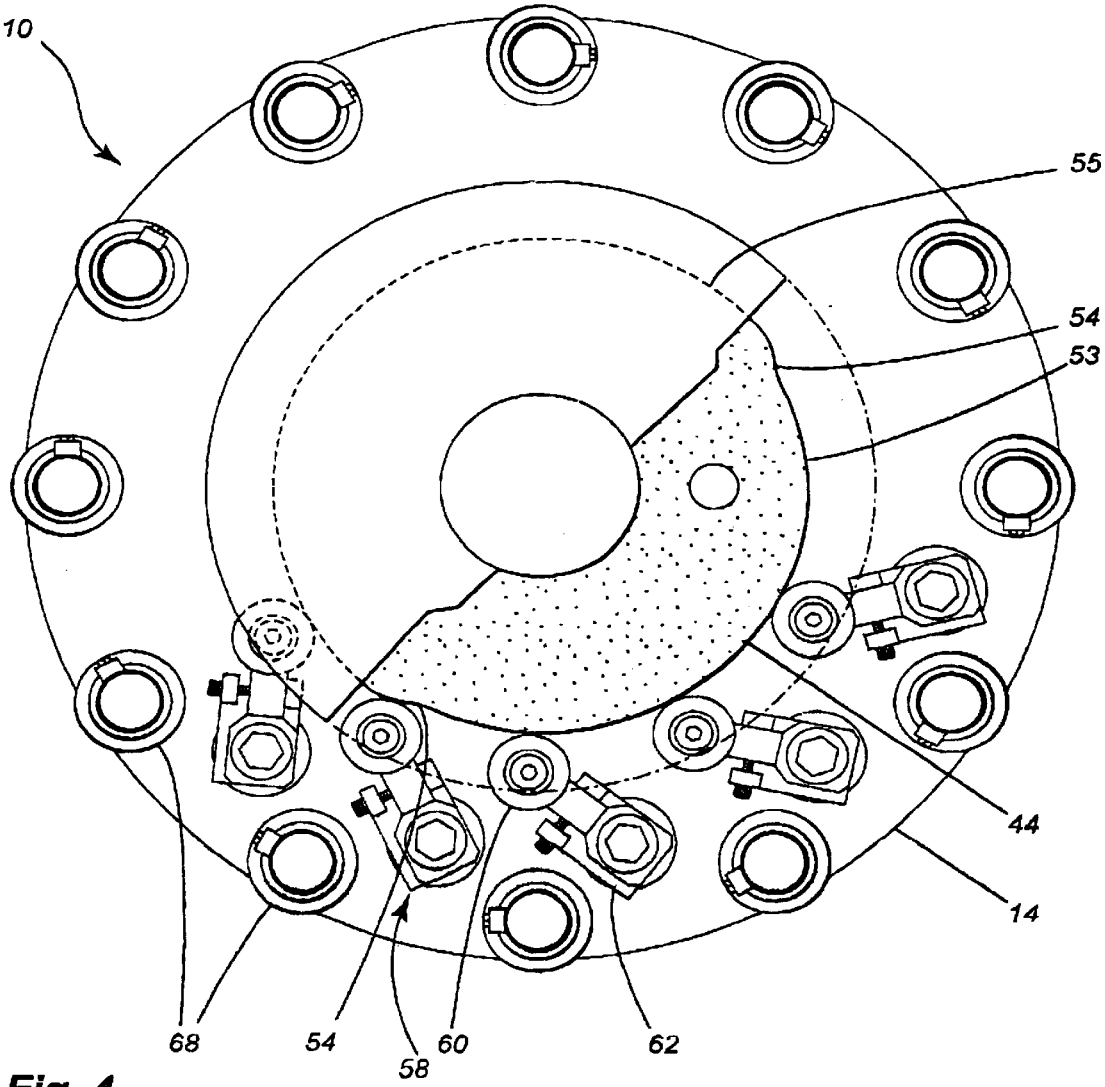
FIG. 4 is a cross sectional view taken along line 4—4 of the revolving turret shown in FIG. 2.
Figure 5:
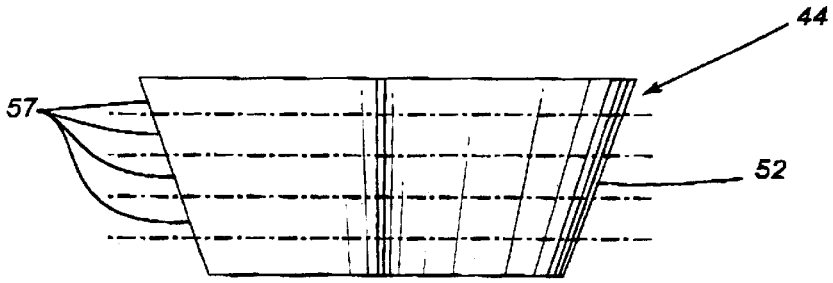
FIG. 5 is a side elevational view of a cam of the crimping apparatus shown in FIG. 2. This figure also shows in stippled lines the cam follower receiving positions defined by the outer face of the cam.

The adjustment mechanism is mounted above the upper revolving turret 14 and, in FIG. 2 is designated by the reference numeral 42. The adjustment mechanism 42 includes a cam 44 and a drive unit 46 that can selectively displace the cam 44 vertically such as to change the profile that the cam 44 presents to cam followers of respective crimping heads 18. The drive unit 46 comprises an electric motor 48 and a transmission system 50 (partially shown) that uses gears (not shown), to convert the rotary movement of the motor 48 into a transitional movement that is imparted to the cam 44. Accordingly, by driving the motor in one direction of rotation, the cam 44 is caused to move horizontally up. By reversing the direction of rotation of the motor 48, the cam 44 is caused to move down. The cam 44, which is generally shaped as a truncated cone, includes an outer face 52 on which cam followers of the individual crimping heads 18 ride. More specifically, FIG. 5 shows that cam 44 defines a plurality of possible cam follower receiving positions 57. Although FIG. 5 shows each respective cam follower receiving position 57 as being delimited by stippled lines, it should be expressly understood that no physical barriers per se define each section. The stippled lines shown have been arbitrarily chosen merely for illustrating the fact that cam 44 can include a plurality of cam follower receiving positions 57. In an alternative embodiment not shown, cam 44 can feature a ridged outer face 52 in order to more clearly define each cam follower receiving position 57. The truncated conical shape of cam 44 is disturbed only at two diametrically opposed locations 54. As shown in FIG. 4, at these locations 54 the profile of a given cam follower receiving position 57 is divided into first and second segments 53, 55 respectively. The first segment 53 is characterized by a smaller radius (with respect to the central vertical axis of cam 44) than that which characterizes the second segment 55.

Each crimping head 18 includes a main body 56 that is secured in an aperture formed on the upper revolving turret 14. At the upper end of the main body 56 is mounted a cam follower 58. The cam follower 58 includes a roller 60 that continuously engages a cam follower receiving position 57. The roller 60 is mounted to a short arm 62. An internal shaft that extends within the body 56 and pivotally mounted therein is keyed to the short arm 62. During a revolution of upper revolving turret 14, the cam follower 58 of each crimping head 18 rides along the first and second segments 53, 55 of cam 44. As a result, when the roller 60 rides along a given cam follower receiving position 57, the movement imparted to the short arm 62 such as when the roller 60 passes over a location 54 (i.e., which implies a transition from one segment to another) is communicated in the from of pivotal movement to the internal shaft.

At its lower extremity, the crimping head carries an arm 64 that extends generally horizontally and supports at one end a crimping tool 66 in the form of a disk. The arm 64 is keyed to the internal shaft. This causes the crimping tool 66 to move in unison with the cam follower 58. In other words, the movement of the cam follower 58 imparted by the profile of the cam 44 are transmitted to the crimping tool 66.

The internal shaft is engaged with a resilient member such as a spring mounted in the body 56 of the crimping head 18, that at rest urges the cam follower 58 and the crimping tool 66 to pivot in a clockwise direction (when the crimping head 18 is seen from above). As a result, the spring urges the roller 60 in continuous engagement with cam 44.

In addition to the array of crimping heads 18, the upper revolving turret 14 also comprises an array of closure holders 68, there being one closure holder 68 associated with each crimping head 18. (Several closure holders 68 have been removed from the frontal portion of FIG. 2 for the sake of clarity.) The function of closure holder 68 is to engage from the top a container 16 whose closure is being crimped such as to prevent the sleeve 28 from spinning on the container neck. Each closure holder 68 is a simple piston cylinder assembly (such as of the pneumatic type) that can reciprocate along a vertical axis. At its lower end, the closure holder 68 includes a generally cylindrical element 69 that physically engages the closure on the container. The cylindrical element 69 is free to rotate about the reciprocating axis of the piston cylinder assembly. More particularly, during the crimping operation, the piston cylinder assembly is extended such that the cylindrical element 69 engages the closure 26 while the crimping tool 66 creates the crimp. In light of the fact that the cylindrical element 69 can turn, the container 16 is free to rotate in spite of the fact that it is engaged by the closure holder 68.

During the operation of the apparatus, the position of each crimping tool 66 should be accurately maintained with relation to the closure 26 of the container 16 to be crimped. If, during the crimping operation, the position of the crimping tool 66 is improper with relation to the neck of the container 16, the crimping operation will not be performed correctly. Before each production run, the machine 10 must be properly set in accordance with the particular type of container 16 to be processed. The setting of the machine is performed by adjusting the vertical position of the cam 44. By displacing the cam downwardly, all the cam followers 58 are caused to slightly pivot in a counter-clockwise direction which imparts the same motion to the crimping tools 66. Stated otherwise, this movement brings the edge of the crimping disk closer to the container seats 71. Such a position would be suitable when containers having small necks are to be crimped. In contrast, when containers with larger necks are to be crimped, the opposite adjustment is performed in order to retract the crimping tools 66. It suffices to raise the cam 44 so as to allow the cam followers 58 under the effect of the internal springs to pivot slightly in a clockwise direction.

The adjustment mechanism 42 is very practical because it allows to quickly set the machine for different production runs. The adjustments are accurate and performed simultaneously on all of the crimping heads 18.

In operation, when a container 16 that has previously received a closure 26 is deposited onto a closure seat 71, it is associated with a crimping head 18 and with a closure holder 68. Since the speed of the upper revolving turret 14 is equivalent to the speed of lower revolving turret 31, the four elements, namely the container 16, the crimping head 18, the container seat 71, and closure holder 68 move in unison. The closure holder 68 stands directly above the closure 26 and cylindrical element 69 is lowered to bear on the top face of the closure 26. This locks the sleeve 28 in place and prevents it from spinning on the neck of the container 16. It also stabilizes the container 16 on its respective container seat 71. The cam follower 58 of the crimping head 18 engages the location 54 on the cam 44 and thereby travels along the second segment 55. This causes the crimping tool 66 to move towards the neck of the container and bend inwardly the lower portion of the sleeve 28. At the same time, the container 16 is being rotated by the container seat 71. Thus, the crimping action is progressively extended to the entire circumference of the sleeve 28. As a result, a complete crimp is formed which abuts against the radial projection and prevents the closure from being removed. After the crimp is completed, the cam follower 58 descends from the second segment 55 by engaging the diametrically opposed location 54, and thereby travels along the first segment 53, which causes the crimping tool 66 to move away from the container 16. At the same time, the closure holder 68 is disengaged by raising it from the now crimped closure 26. The container 16, as depicted in FIG. 1, is then received within a slot 5' featured on the outer periphery of the outfeed start wheel 7' and is thereby transported toward outlet conveyor 12'. The containers 16 can therefore be carried off toward another processing station such as a labelling station, a packaging station, etc.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A crimping apparatus, comprising:

a) a revolving turret supporting a plurality of crimping heads, each crimping head operative to engage a closure on a container to create a crimp in the closure;

b) a cam;

c) each crimping head, including:

i) a cam follower for engaging said cam;

ii) said cam defining a plurality of possible cam follower receiving positions;

iii) each cam follower receiving position defining a certain profile;

iv) when said turret revolves said cam follower moving along the profile of the cam follower receiving position at which said cam follower is located;

v) a crimping tool associated with said cam follower, said cam follower imparting motion to said crimping tool when movement is communicated to said cam follower by said cam;

d) said cam and said revolving turret being selectively displaceable one relative to the other as a result of a movement other than the revolution of said revolving turret to cause said cam follower to engage said cam at a different cam follower receiving position.

2. A crimping apparatus as defined in claim 1, wherein said revolving turret revolves about an axis of revolution, said cam and said revolving turret being selectively displaceable one relative to the other along said axis of revolution to cause said cam follower to engage said cam at a different cam follower receiving position.

3. A crimping apparatus as defined in claim 2, wherein said axis of revolution is generally vertical.

4. A crimping apparatus as defined in claim 1, wherein said cam is tapered along said axis of revolution.

5. A crimping apparatus as defined in claim 4, wherein the profile at a certain cam follower receiving position of said cam includes:

a) a first segment;

b) a second segment;

c) said cam follower riding on said first and said second segments during a revolution of said revolving turret;

d) said cam follower causing said crimping tool to move toward a closure on a container to create a crimp in the closure when said cam follower transitions from said first segment to said second segment.

6. A crimping apparatus as defined in claim 5, wherein when said cam follower engages said first segment, said crimping head is at a position remote from a closure on a container to be crimped by said crimping head.

7. A crimping apparatus as defined in claim 6, wherein the second segment of the profile of each cam follower receiving positions sets said crimping head at a selected position with relation to a container to be crimped.

8. A crimping apparatus as defined in claim 1, wherein said revolving turret is a first revolving turret, said crimping apparatus further comprising a second revolving turret underlying and associated to said first revolving turret, said first and second revolving turrets adapted to rotate at the same rotational speed.

9. A crimping apparatus as defined in claim 8, wherein said second revolving turret comprises a plurality of container seats, each container seat being associated with a respective crimping head.

10. A crimping apparatus as defined in claim 9, wherein each container seat is operative to support a container while the closure of the container is being crimped by the respective crimping head.

11. A crimping apparatus as defined in claim 10, wherein each container seat is operative to impart a rotating movement of a container received by the container seat.

12. A crimping apparatus as defined in claim 11, wherein said first revolving turret includes a plurality of closure holders, each closure holder being associated with a respective crimping head, a closure holder being operative to engage the closure of a container to be crimped to prevent the closure from spinning on a neck of the container while the container is being rotated by the container seat.

13. A crimping apparatus as defined in claim 8, wherein said first revolving turret is disposed generally in a horizontal plane.

14. A crimping apparatus as defined in claim 13, wherein said crimping heads are mounted to said first revolving turret at constant angular intervals.

15. A crimping apparatus as defined in claim 14, wherein each crimping head includes a substantially vertically extending body, said cam follower being mounted to an upper end of said body.

16. A crimping apparatus as defined in claim 15, wherein each crimping head includes an arm supporting said crimping tool, said arm being mounted to a lower end of said body.

17. A crimping head as defined in claim 16, wherein said crimping tool is a disk.

* * * * *